US011670195B2

(12) United States Patent
Mitchell

(10) Patent No.: US 11,670,195 B2
(45) Date of Patent: Jun. 6, 2023

(54) ORGANIZATION AND STORAGE SYSTEM AND METHOD OF USE

(71) Applicant: Stanley Mitchell, Kansas City, KS (US)

(72) Inventor: Stanley Mitchell, Kansas City, KS (US)

( * ) Notice: Subject to any disclaimer, the term of this patent is extended or adjusted under 35 U.S.C. 154(b) by 120 days.

(21) Appl. No.: 17/351,031

(22) Filed: Jun. 17, 2021

(65) Prior Publication Data

US 2021/0398458 A1 Dec. 23, 2021

Related U.S. Application Data

(60) Provisional application No. 63/040,315, filed on Jun. 17, 2020.

(51) Int. Cl.

| | |
|---|---|
| ***G09F 3/20*** | (2006.01) |
| ***A44B 15/00*** | (2006.01) |
| ***B65D 25/20*** | (2006.01) |
| ***B65D 25/10*** | (2006.01) |
| ***G09F 23/00*** | (2006.01) |

(52) U.S. Cl.

CPC ..... *G09F 3/201* (2013.01); *A44B 15/00* (2013.01); *A44B 15/005* (2013.01); *B65D 25/108* (2013.01); *B65D 25/205* (2013.01); *G09F 23/00* (2013.01)

(58) Field of Classification Search

CPC ..... G09F 3/201; G09F 23/00; A44B 15/00; A44B 15/005; B65D 25/108; B65D 25/205; A45C 11/323; A45C 11/32; A45C 2011/188

See application file for complete search history.

(56) References Cited

U.S. PATENT DOCUMENTS 2,312,204 A * 2/1943 Weindel, Jr. ..... G09F 3/18 40/634
2,793,451 A * 5/1957 Goldsholl ..... C07D 213/78 D20/27
2,812,601 A * 11/1957 Hines ..... A44B 15/005 40/634
4,072,033 A * 2/1978 Eckerdt ..... A47G 29/10 70/459
4,704,770 A * 11/1987 Minami ..... G09F 23/00 24/431

(Continued)

*Primary Examiner* — David R Dunn
*Assistant Examiner* — Christopher E Veraa
(74) *Attorney, Agent, or Firm* — Law Office of Mark Brown, LLC; Christopher M. DeBacker

(57) ABSTRACT

An organization and storage system and method including a hang tag piece for attachment to an object to be organized and stored and a case configured for receiving and housing the object and hang tag piece. In an exemplary embodiment, the present invention is utilized for organizing and storing flash drives. The hang tag piece includes an end slot opening leading to an inner cavity; a label; a side display configured for displaying the label within the inner cavity; a protector piece configured for protecting the label; and attachment holes on each end. The case includes an open internal space for receiving and holding the object to be organized and stored and attached hang tag piece and further includes a case label corresponding to the hang tag label and object to be organized and stored.

18 Claims, 9 Drawing Sheets

(56) References Cited

U.S. PATENT DOCUMENTS 4,746,045 A * 5/1988 Schweim ..... A63B 71/0672 224/269
4,789,573 A * 12/1988 Jenkinson ..... A45C 13/08 428/30
5,467,871 A * 11/1995 DeField ..... G09F 23/00 206/38.1
D419,289 S * 1/2000 Edwards ..... D3/208
6,089,060 A * 7/2000 Steeley ..... E05B 19/00 70/459
6,443,306 B1 * 9/2002 Davies ..... G11B 33/0416 206/307
6,533,111 B1 * 3/2003 Harden ..... A45C 11/32 206/38.1
6,543,161 B2 * 4/2003 Chin ..... G09F 3/20 40/6
6,594,154 B1 * 7/2003 Brewer ..... A45C 11/18 361/752
6,848,577 B2 * 2/2005 Kawamura ..... A45C 11/182 206/37
6,948,614 B1 * 9/2005 Hall ..... A45C 11/329 206/38.1
7,350,385 B1 * 4/2008 Book ..... A45C 11/32 24/615
7,475,816 B1 * 1/2009 Rochelo ..... A45C 11/18 235/487
7,482,680 B2 * 1/2009 Brewer ..... H05K 5/0278 439/138
7,841,535 B2 * 11/2010 Walker ..... G06K 19/00 235/375
D634,117 S * 3/2011 Morrish ..... D3/207
8,915,356 B1 * 12/2014 Cha ..... A45C 13/1069 206/37.8
9,961,968 B1 * 5/2018 Mulcahy ..... G07C 9/00
2003/0057277 A1 * 3/2003 Kimura ..... G06K 19/07739 235/449
2004/0045863 A1 * 3/2004 Rhoades ..... B65D 25/02 206/534
2005/0097801 A1 * 5/2005 Kang ..... G09F 23/00 40/661
2005/0144826 A1 * 7/2005 Murphy ..... G09F 3/02 40/641
2005/0160649 A1 * 7/2005 Bieber ..... G09F 3/20 40/661
2007/0283608 A1 * 12/2007 Gunderson ..... G09F 23/00 40/634
2008/0016741 A1 * 1/2008 Cheng ..... G09F 7/10 40/661
2008/0209966 A1 * 9/2008 Howard ..... A44B 15/002 70/459
2009/0014344 A1 * 1/2009 Altman ..... B65D 75/22 206/307.1
2009/0090641 A1 * 4/2009 McCrink ..... A63F 3/068 206/0.81
2009/0133455 A1 * 5/2009 Yang ..... A45F 5/02 70/457
2010/0230304 A1 * 9/2010 Plutsky ..... A45C 11/18 206/307
2011/0047846 A1 * 3/2011 Hughes ..... G09F 3/20 40/673
2012/0042550 A1 * 2/2012 Chang ..... G09F 3/207 40/634
2012/0239836 A1 * 9/2012 Enayati ..... A44B 15/005 361/679.31
2015/0068258 A1 * 3/2015 Jiang ..... A44B 15/00 24/601.5
2015/0264830 A1 * 9/2015 Banacki ..... B65D 25/205 206/307
2017/0001784 A1 * 1/2017 Jones ..... A45C 15/06
2017/0273870 A1 * 9/2017 Radomil ..... B65D 21/023
2019/0164028 A1 * 5/2019 Fellman ..... A45C 11/18
2020/0060402 A1 * 2/2020 McCarty ..... A45C 11/182

* cited by examiner

ORGANIZATION AND STORAGE SYSTEM AND METHOD OF USE

CROSS-REFERENCE TO RELATED APPLICATION

This application claims priority in U.S. Provisional Patent Application No. 63/040,315, filed Jun. 17, 2020, which is incorporated herein by reference in its entirety.

BACKGROUND OF THE INVENTION

1. Field of the Invention

The present invention relates generally to organization and storage systems and methods for use thereof, and more specifically to a system and method of labeling, organizing, and storing flash drives.

2. Description of the Related Art

Flash drives, also known as USB drives, thumb drives, jump drives, or memory sticks, are compact devices commonly used for saving, storing, and/or transferring various types of digital files between computing devices, such as desktop or laptop computer hard drives. Additionally, most televisions on the market today are equipped with USB ports allowing users to insert a flash drive into the television and play saved video and/or audio files via the television display screen and speakers. Accordingly, many consumers store digital video and/or audio files on flash drives for use with their televisions.

The compact design of flash drives accommodates easy transport in a user's pocket, in a user's bag, on a user's keychain, on a lanyard around a user's neck or wrist, or via another mode of transport. However, such compact design also results in limited capacity for each flash drive, often leading to users having numerous flash drives to store their electronic files and media. With a multitude of flash drives, the content saved on each can be easily confused, which in turn can lead to a user wasting time reviewing files on multiple flash drives before locating a desired digital file. Another disadvantage of flash drives being compact is that they tend to be easily lost or misplaced. What is needed is an efficient system and method for organizing and storing flash drives to cut down on lost, misplaced, and/or mixed-up flash drives.

Heretofore there has not been available an organization and storage system and method with the advantages and features of the present invention.

SUMMARY OF THE INVENTION

The present invention discloses an organization and storage system and method. The present system includes a hang tag piece configured for attachment to an object to be organized and stored and a case configured for receiving and housing the object and the attached hang tag piece.

In an embodiment of the present invention, the hang tag piece includes an end slot opening leading to an inner cavity and configured for receiving a label; a side display configured for displaying the label; a protector piece configured for enclosing and protecting the label; and attachment holes on each end, each attachment hole configured for connecting to a key ring, lanyard, hook, other carrying or mounting mechanism, or combinations thereof. In an exemplary embodiment, an attached key ring helps hold the label and protector piece in place by connecting through the end slot opening, preventing the label and protector piece from falling out of the end slot opening. In alternative embodiments, other locking mechanisms are utilized in place of a key ring for connecting through the end slot opening to hold the label and protector piece in place. In an exemplary embodiment utilizing a key ring, to remove and/or replace the label of the present invention, the key ring is removed; the label and protector piece are removed; and the protector piece is opened for access to the label. The label may then be replaced with a new or modified label; the new or modified label placed within the protector piece; the protector piece closed around the new or modified label; the label and protector piece reinserted into the hang tag end slot opening; and the key ring reattached.

In an aspect of the present invention, the case includes an open internal space configured for receiving and holding the object to be organized and the attached hang tag piece. In an exemplary embodiment, the case includes a molded receiver configured for holding the object and hang tag piece without the object and hang tag piece sliding around within the case. The case includes one or more case labels corresponding to the label on the hang tag piece. The case label can either be attached to the outside of the case via adhesive or placed within the case and visible through a clear case display.

In use of an exemplary embodiment of the present invention, a hang tag piece is attached to a flash drive via a lanyard or alternative attachment piece connected around the lanyard loop of the flash drive and around one of the hang tag piece end holes, preferably the attachment hole on the opposite side of the hang tag piece end slot opening. A description or notation regarding the contents of the flash drive are written on a label; the label is inserted into a protector piece; and the label and protector piece are inserted into the end slot opening with the written description or notation displayed through the clear top display. Preferably, a key ring or alternative locking piece is attached to the end attachment hole on the same end as the end slot opening, holding the label and protector piece within the hang tag piece inner cavity. A corresponding case label is placed on or in a case so that the case label is displayed from outside of the case. The flash drive with the attached, labeled hang tag piece is placed within the corresponding case, and the case is closed. The case holding the flash drive and hang tag piece can then be stored and organized in a tidy manner, allowing for quick and efficient storage and retrieval of a desired flash drive with desired digital files.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
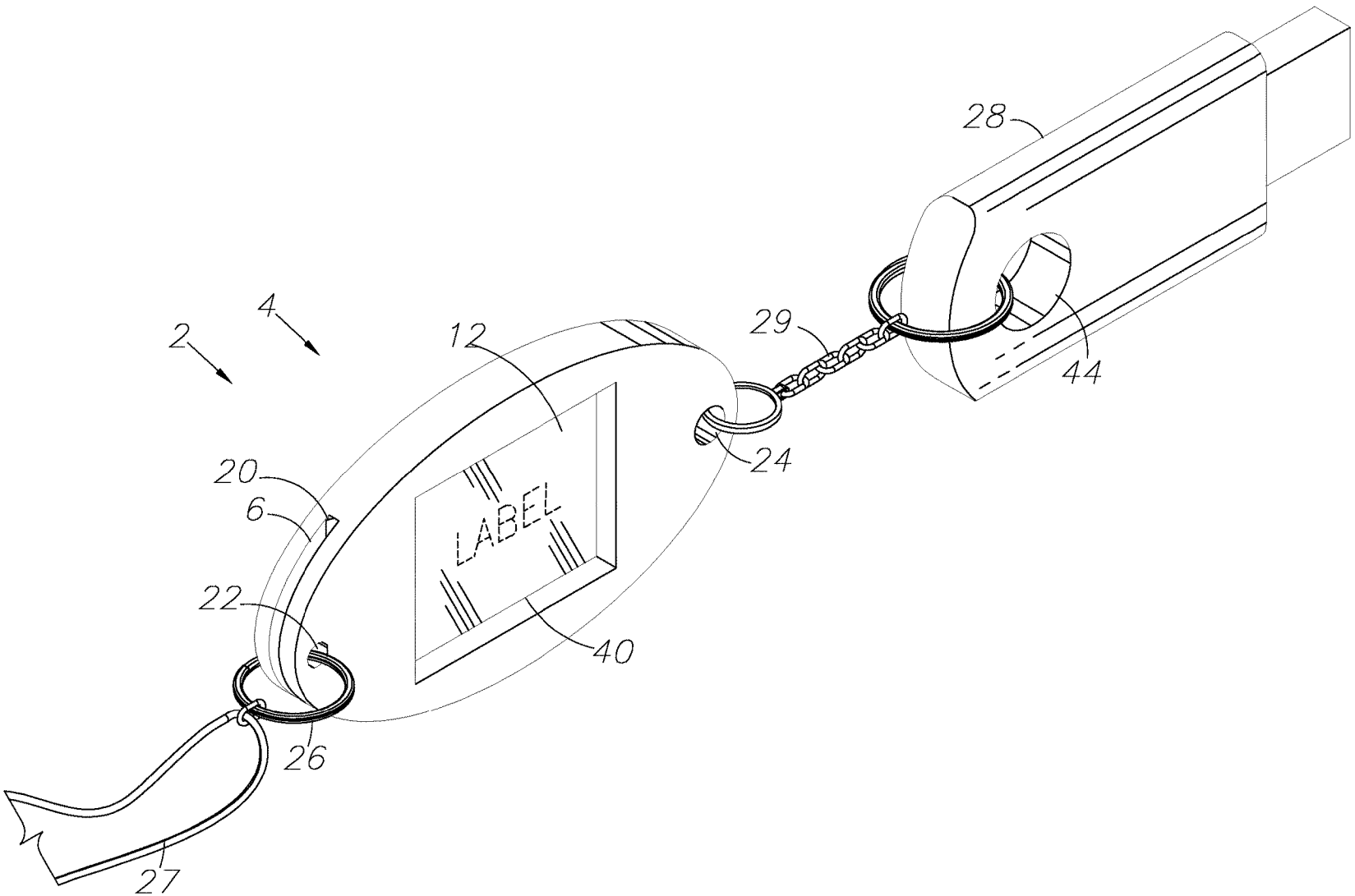
FIG. 1 is an upper, front, perspective view of a hang tag piece of an organization and storage system embodying the present invention.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Additionally, anatomical terms are given their usual meanings. For example, proximal means closer to the trunk of the body, and distal means further from the trunk of the body. Said terminology will include the words specifically mentioned, derivatives thereof and words of similar meaning.

II. Preferred Embodiment

The present invention is an organization and storage system and method 2 for efficient identification, arrangement, housing, and retrieval of desired objects to be organized and stored. The organization and storage system 2 includes a hang tag piece 4 configured for attachment to an object to be organized and stored and a case 32 configured for receiving and housing the object and the attached hang tag piece 4.

In an exemplary embodiment, the present invention is used to label, store, and organize flash drives containing saved digital content. In the digital age we live in today, people often use digital memory storage devices, such as but not limited to hard drives and flash drives, to store digital files, documents, media, etc. Flash drives are advantageous in many situations over hard drives because flash drives are compact and portable, accommodating easy access to files between multiple computing devices and/or display screens. However, the compact, portable design of flash drives also has tradeoffs, such as limited storage capacity for each individual flash drive. This often leads to a user having numerous flash drives to store the user's various digital content. Having numerous, compact flash drives commonly results in flash drives being misplaced or mixed up, which in turn can result in significant wasted time looking for a desired digital file. The present invention provides a system and method for resolving such issues and efficiently organizing and storing flash drives. Additionally, with currently-sold display monitors, televisions, speaker systems, cars, and other electronic devices being equipped with USB ports, the music and entertainment industries may plausibly move toward selling music, movies, videos, and other digital media on flash drives rather than on larger mediums like discs (i.e., CDs, DVDs, Blu-ray Discs). Thus, in addition to providing a system and method for efficiently organizing and storing one's digital media, the present invention provides the music and entertainment industries with a new system and method for packaging music, movies, videos, and other digital media for retail sales. Further, new forms of electronic media called non-fungible tokens (NFTs) have gained popularity and may be saved on flash drives and organized and stored utilizing the present invention.

In other embodiments, the organization and storage system 2 of the present invention may alternatively be used with objects to be organized and stored other than flash drives. For a non-limiting example, the present invention may be utilized for organizing and storing collectables such as stamps, coins, sports cards, etc. Moreover, technology is ever-changing, and digital files may eventually be stored on alternative devices not yet developed. The present invention may also be used in the future for organization and storage of such yet to be developed devices.

Referring to the drawings in more detail, FIGS. 1-11 show an exemplary embodiment of an organization and storage system 2 of the present invention. The hang tag piece 4 is configured for attachment to an object to be organized and for providing a label 10 and/or identification description for the object. The hang tag piece 4 has top, bottom, left, and right sides and first and second ends. A first end of the hang tag piece 4 includes an end slot opening 6 leading to an inner cavity 8 configured for receiving and housing a label 10. The top side of the hang tag piece 4 includes an open display 40 configured for displaying the contents within the hang tag piece inner cavity 8. The hang tag piece 4 further includes attachment holes 22, 24 through the hang tag piece 4 on both ends, with the holes on the first end 22 extending through on either side of the end slot opening 6 in the same geometric plane. The attachment holes on both ends 22, 24 of the hang tag piece 4 are each configured for attachment to a key ring 26, lanyard, clip, hook, or other attachment or locking mechanism for attachment to the hang tag piece 4. Placing a key ring 26, lanyard, clip, hook, or other attachment or locking mechanism through the first end attachment holes 22, and thus through the end slot opening 6, helps to hold the label 10 within the hang tag inner cavity 8 by preventing the label 10 from falling out of the end slot opening 6.

In a preferred embodiment, the hang tag piece 4 further includes a protective piece 12 configured for receiving, enclosing, and protecting the label 10; for sliding into the inner cavity 8; and for being visible through the top side open display 40. The protector piece 12 protects the label 10 from damage and accommodates easier sliding in and removal of the label 10 from the inner cavity 8 of the hang tag piece 4. In an exemplary embodiment, the protective piece 12 is clear so that the label 10 can be easily read through the protective piece 12. However, the protective piece 12 may alternatively be slightly tinted or be a translucent color as long as the label 10 is clearly visible through the protective piece 12. The protective piece 12 may be made of plastic, glass, or an alternative clear or translucent material.

Figure 7:
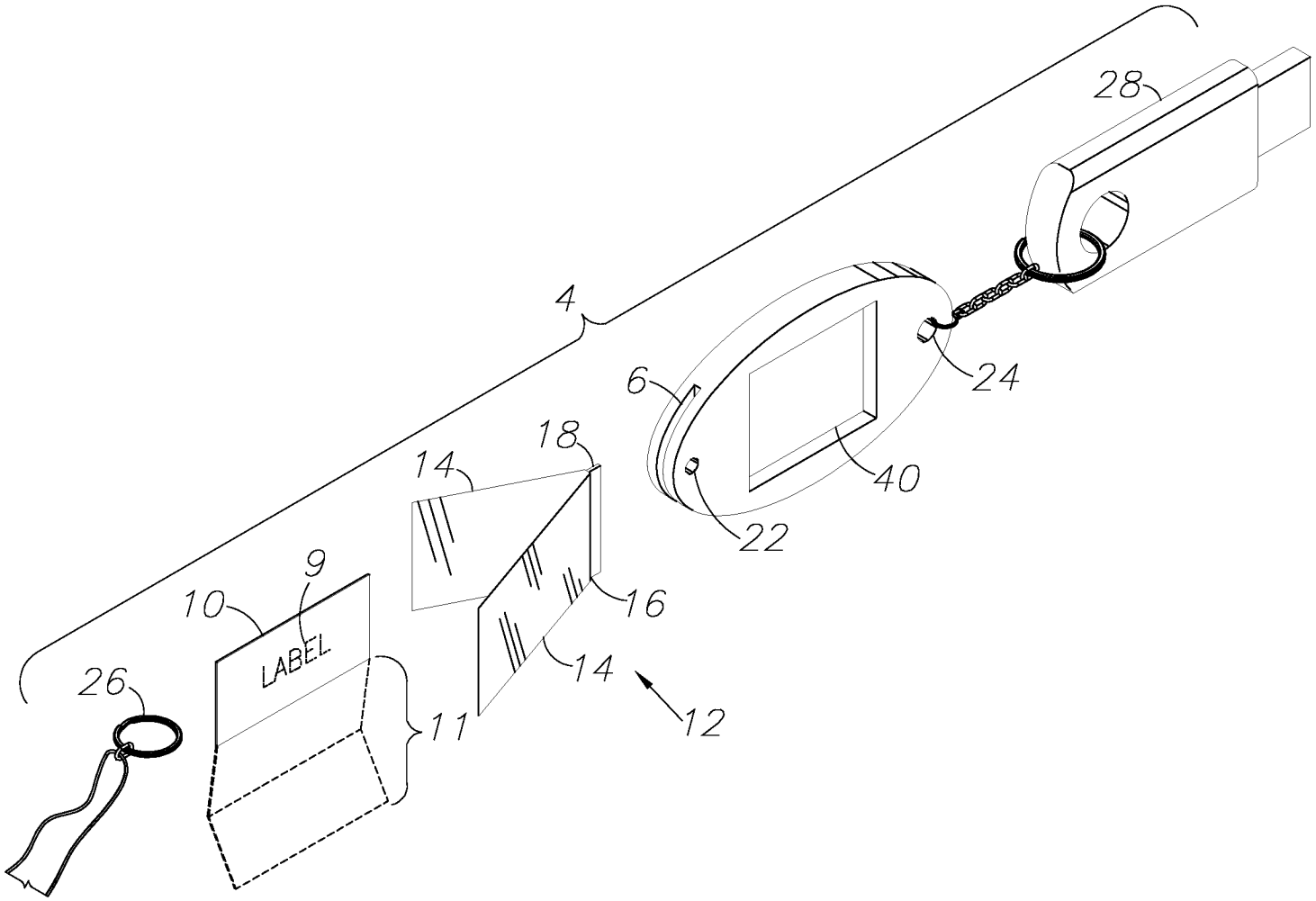
FIG. 7 shows an upper, front, exploded, perspective view of the hang tag piece of the organization and storage system.
Figure 8:
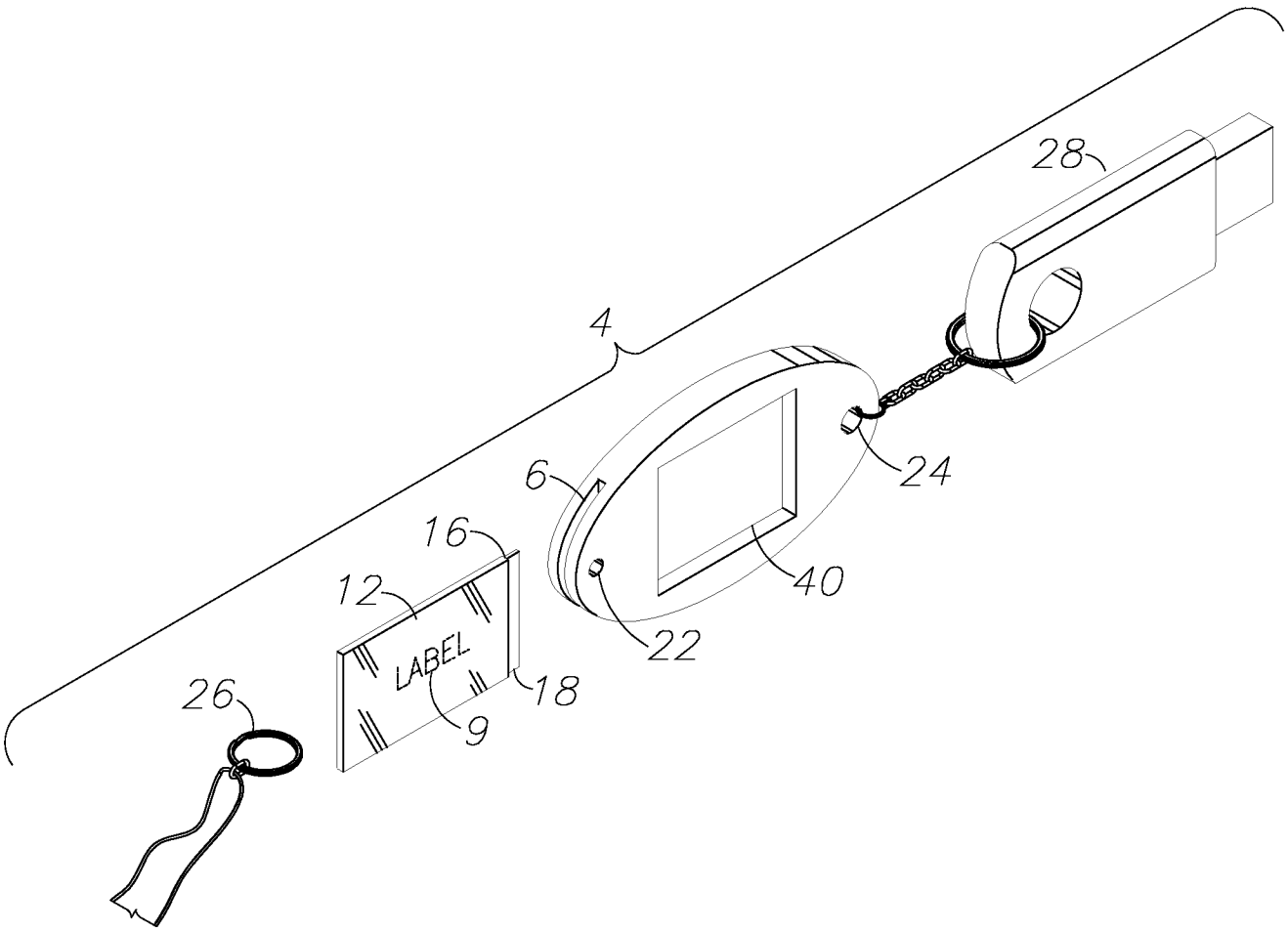
FIG. 8 shows an upper, front, exploded, perspective view of the hang tag piece of the organization and storage system with the label assembled within the protective piece.
Figure 9:
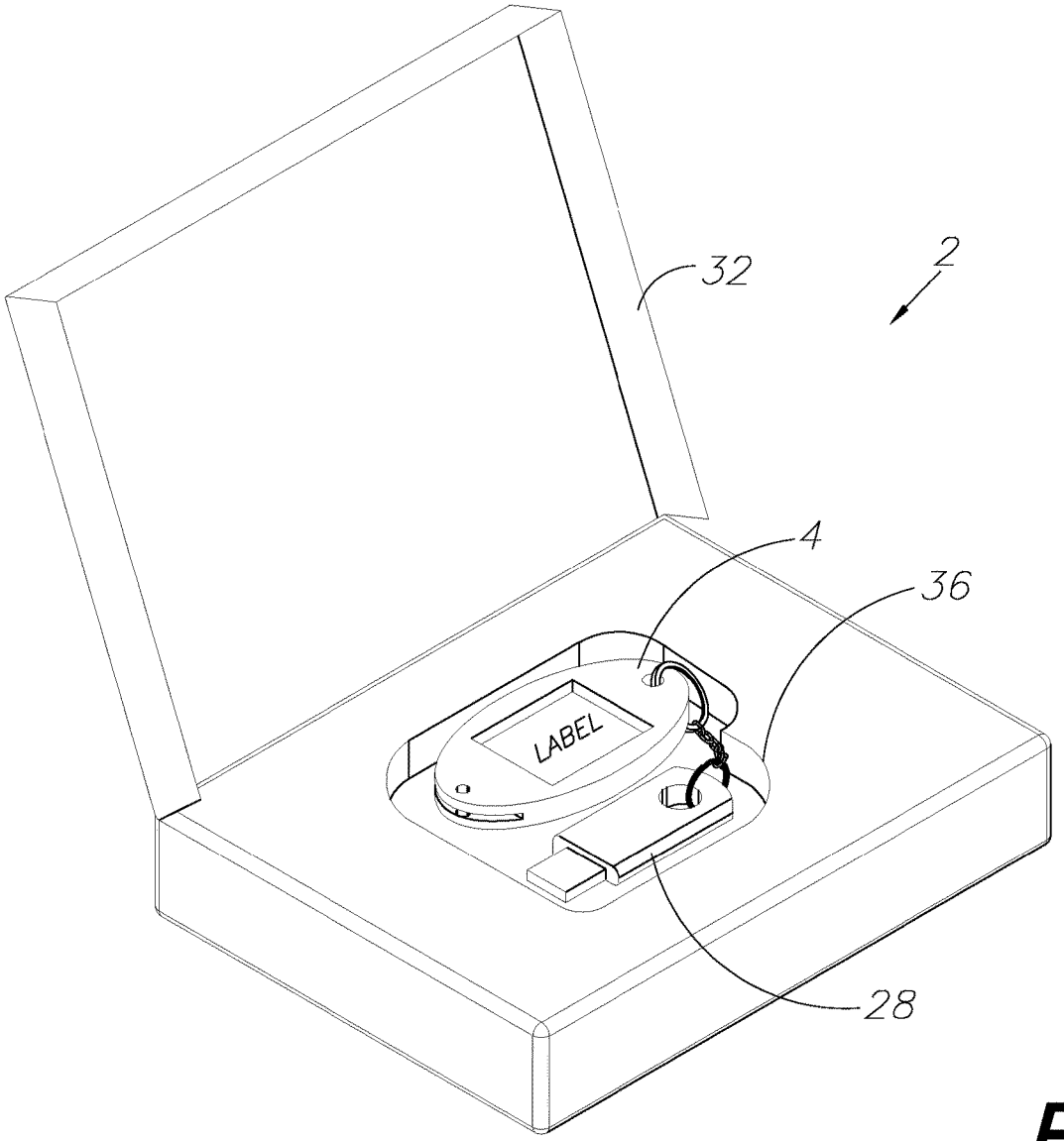
FIG. 9 is an upper, front, perspective view of the organization and storage system with the hang tag piece and an attached flash drive assembled within the case.
Figure 10:
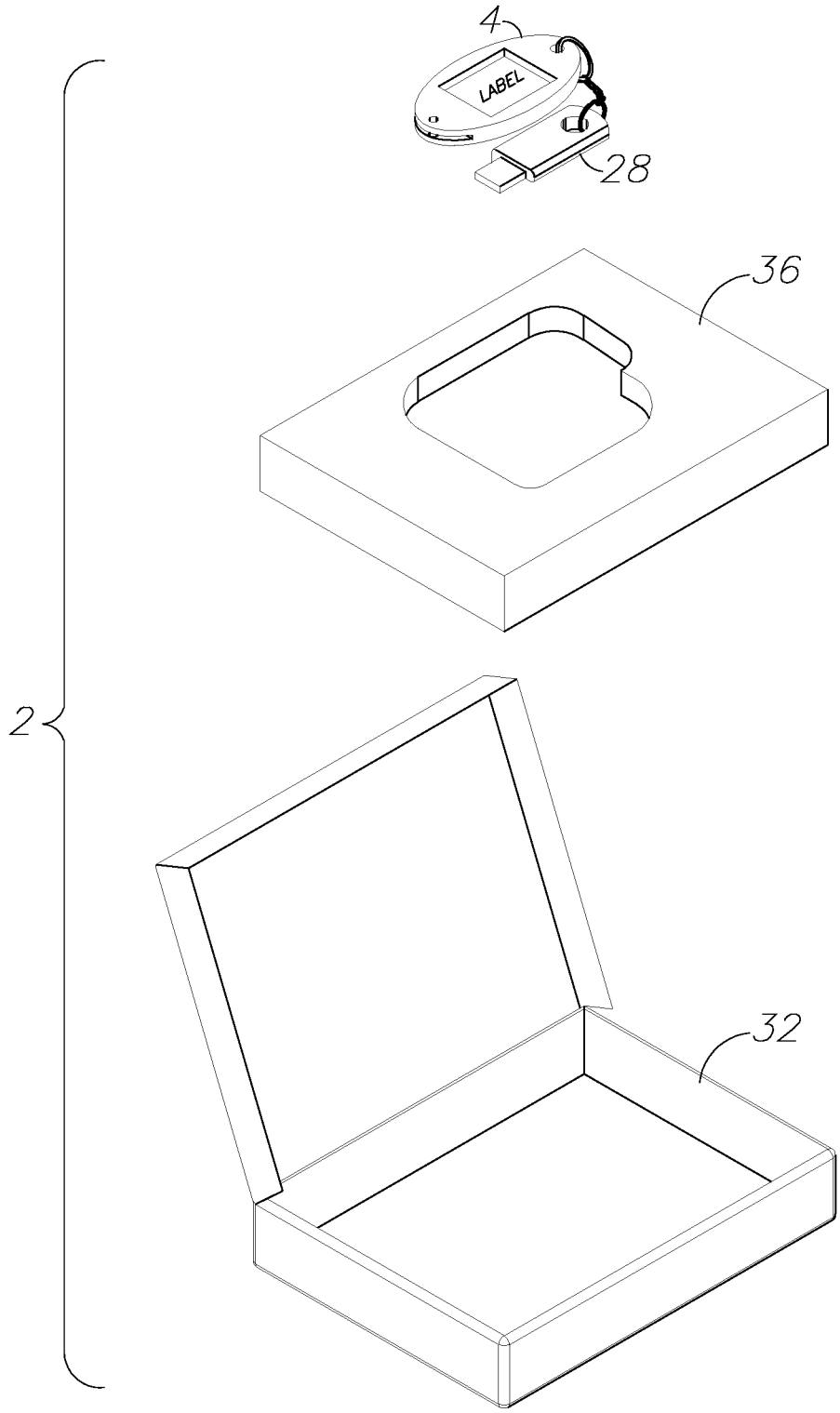
FIG. 10 is an upper, front, exploded, perspective view of the organization and storage system case and hang tag piece with an attached flash drive.

In an exemplary embodiment, as illustrated by FIGS. 7-8, the protective piece 12 includes two rectangular layers of protective material 14 joined at one end 16 and open on the other three sides such that the protective piece 12 opens to receive a label 10 with the joined end 16 holding the layers 14 of the protective piece 12 together. The protective piece 12 is further configured for closing around the label 10. The protective piece joined end 16 may be molded together, crimped together, attached via adhesive, or attached via another attachment mechanism. In alternative embodiments, the protective piece 12 may include a hinge between two layers of protective material 14 to join the two layers 14.

In an exemplary embodiment, the protective piece joined end 16 further includes an end extension 18. Such a joined end extension 18 provides a guide for easier insertion of the protective piece 12 into the end slot opening 6 and inner cavity 8, with the joined end extension 18 inserted through the end slot opening 6 first. However, other embodiments of the present invention do not include a protective piece joined end extension 18. In further embodiments, the present invention may not include a protective piece 12. In such embodiments without a protective piece 12, the user may slide a label 10 directly into the end slot opening 6 and inner cavity 8.

Figure 2:
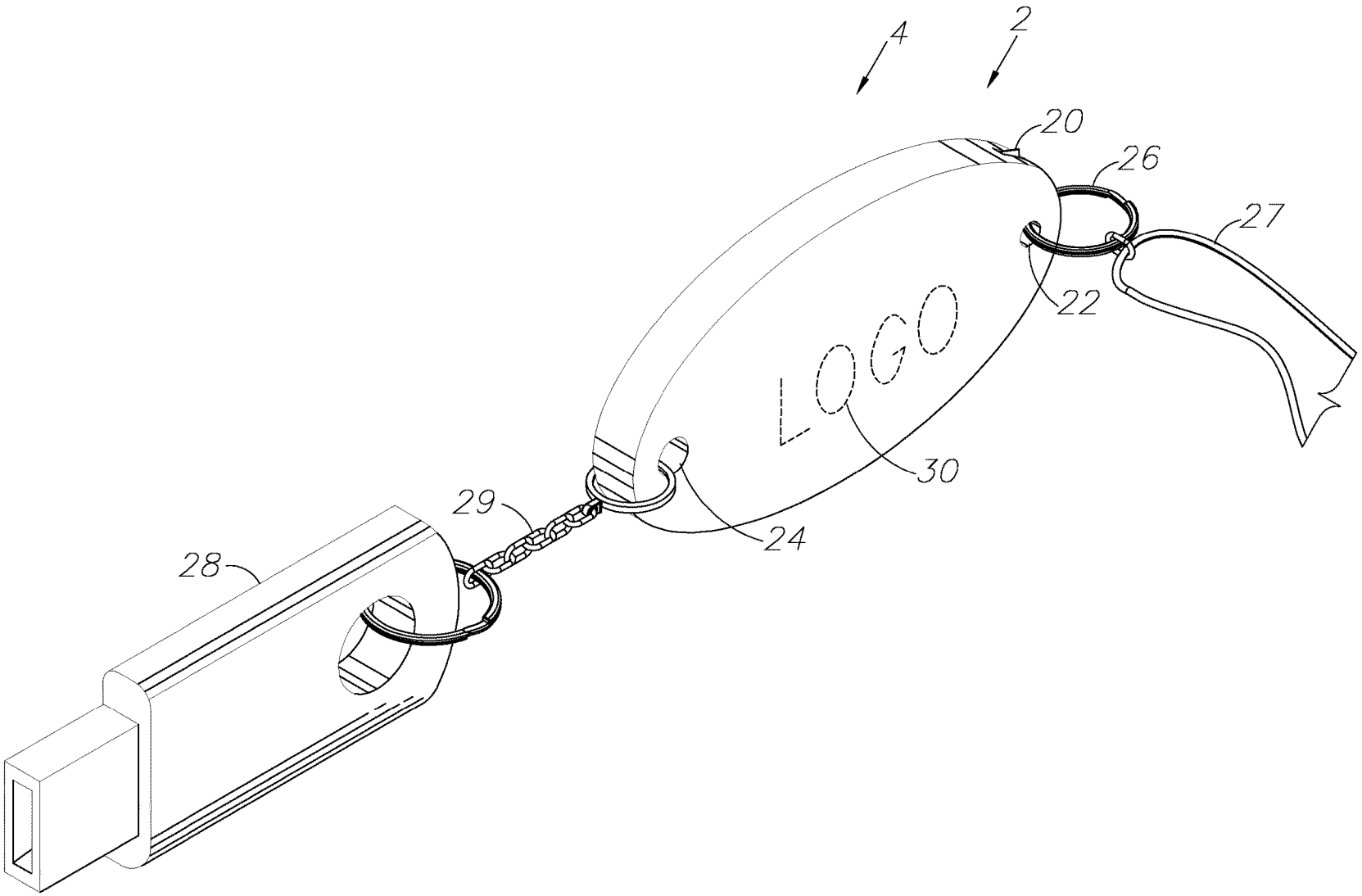
FIG. 2 is a lower, back, perspective view of the hang tag piece of the organization and storage system.
Figure 3:
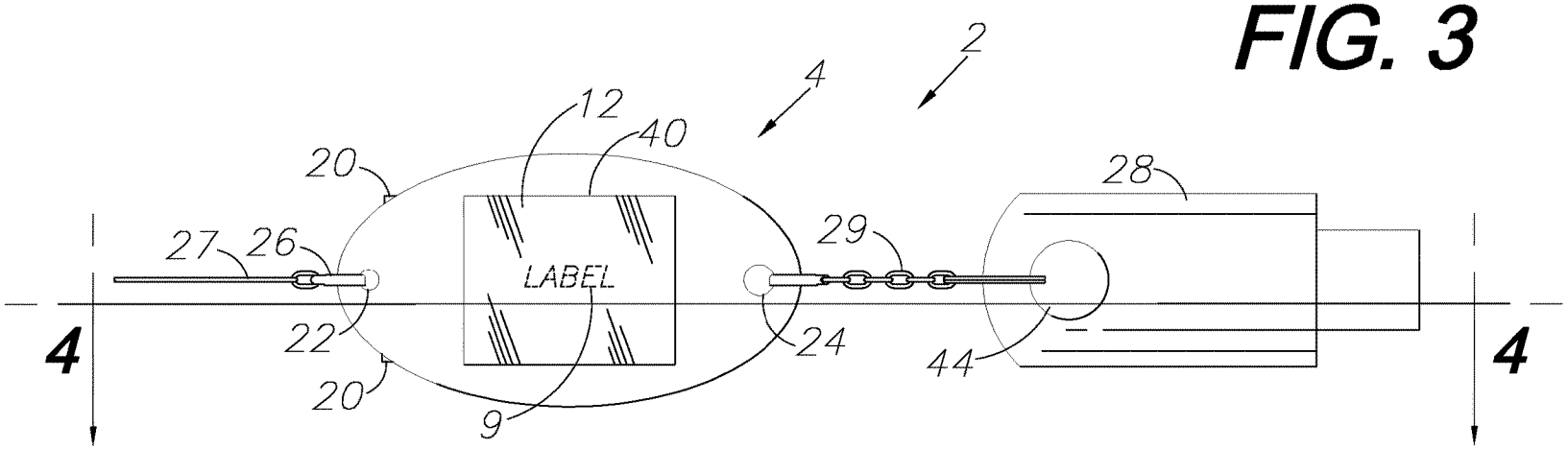
FIG. 3 shows a top, plan view of the hang tag piece of the organization and storage system.
Figure 4:
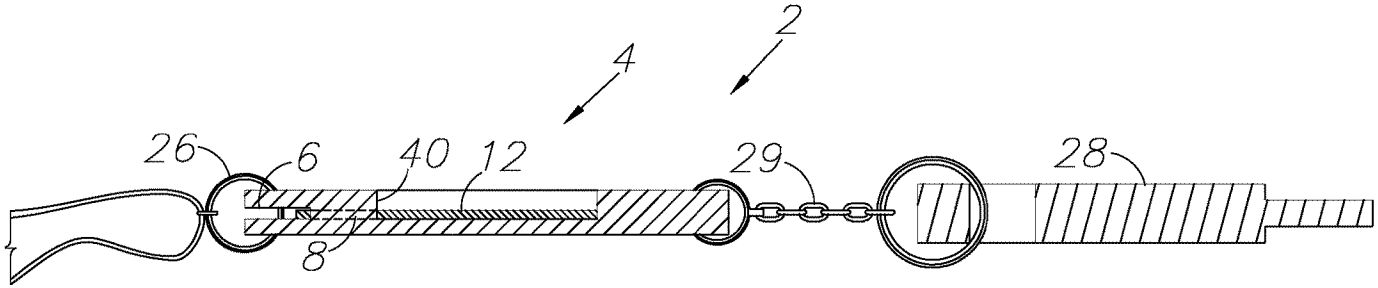
FIG. 4 shows a side, elevational, cross-sectional view of the hang tag piece of the organization and storage system.
Figure 5:
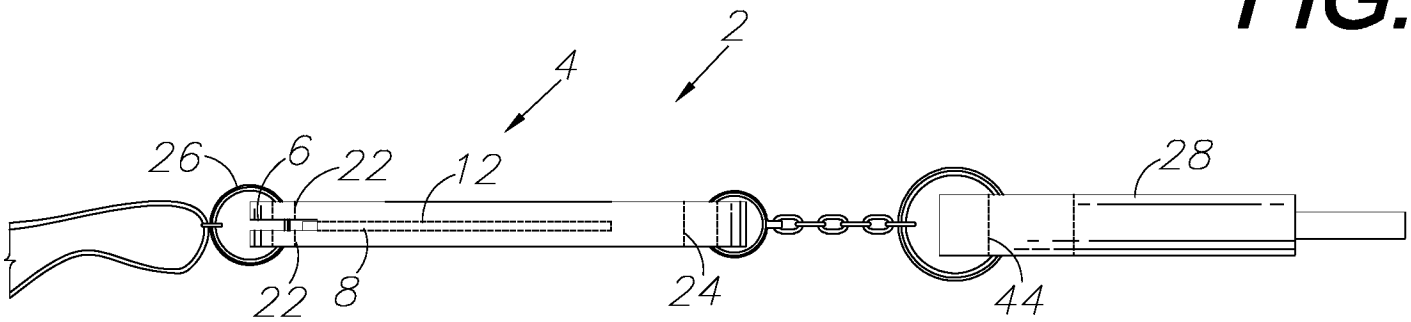
FIG. 5 shows a side, elevational view of the hang tag piece of the organization and storage system.
Figure 6:
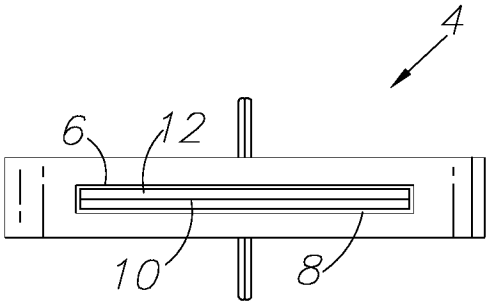
FIG. 6 shows a front, elevational view of the hang tag piece of the organization and storage system.

In a preferred embodiment, as shown in FIGS. 1-3, with the hang tag piece 4 fully assembled, two corners 20 of the protective piece 12 slightly protrude out of the end slot opening 6. These protective piece corners 20 slightly sticking out accommodate easy removal of the protective piece 12 and label 10 from the hang tag inner cavity 8 when desired to review, revise, and/or replace the label 10. However, in alternative embodiments, the entire protective piece 12 fits within the hang tag inner cavity 8 when assembled, without corners protruding out of the end slot opening 6.

In an exemplary embodiment, the label 10 comprises a piece of paper small enough to fit within the protective piece 12 and hang tag inner cavity 8. Preferably, a user of the present invention writes a name and/or description 9 of the content of the object to be organized and stored on the label 10. Such label writing 9 is depicted as a generic "LABEL" in FIGS. 1-11. In an exemplary embodiment, the label may optionally be a folded sheet of paper with a name given to the attached object 9 written on the outward-facing fold of the label 10 and information and/or description of files stored on the object written on the inner fold(s) 11. However, in alternative embodiments, the label 10 consists of a non-folded sheet with a written description or notation 9 only on the outside of the label, visible through the hang tag open display 40 when assembled.

In embodiments of the present invention, the main body of the hang tag piece 4 may be made up of plastic, filament, fiberglass, metal, wood, rubber, or any other solid material. In the embodiment shown in FIGS. 1-10, the hang tag piece 4 is substantially ovular in shape. However, hang tag pieces 4 of the present invention may be formed in any shape or design that will fit within a corresponding case 32, as desired. Additionally, the bottom side of the hang tag piece 4 may optionally include a logo, name, or alternative notation 30 engraved or attached thereto for marketing purposes and/or to assist in identifying the proper owner of the attached object.

The hang tag piece 4 is configured for attachment to the object to be organized and stored via a key ring, lanyard, small chain 29, alternative attachment mechanism, or combinations thereof, connected through one of the hang tag piece end holes 22, 24 and connected to the object. In embodiments for use with a flash drive 28, the hang tag piece attachment mechanism 29 can attach to the flash drive 28 through a flash drive lanyard hole 44, which the majority of flash drives are equipped with.

In an exemplary embodiment, a key ring, clip, hook, or alternative locking mechanism 26 attaches through the hang tag piece planar first end holes 22 on the same side as the end slot opening 6, preventing the label 10 and protective piece 12 from falling out of the end slot opening 6. Such key ring or other locking mechanism 26 attached to the holes 22 through the same end as the end slot opening 6 may be attached to the object to be organized and stored; be attached to another lanyard, keychain, or alternative transport piece 27; or be a standalone key ring or other locking mechanism 26. To access or change the label 10, the key ring or other locking mechanism 26 is simply removed, followed by the protective piece 12 and label 10 being removed from the inner cavity 8. The label 10 can then be reviewed, revised, and/or replaced and reinserted into the protective piece 12. The protective piece 12 is then reinserted into the inner cavity 8 through the end slot opening 6, and the key ring or other locking mechanism 26 reattached to the hang tag piece 4. In some embodiments of the present invention, the locking mechanism 26 may further include a lock requiring a key or code to remove the locking mechanism 26 from the hang tag piece 4, thus limiting access to label 10 removal.

In an exemplary embodiment, the hang tag top open display 40 is an open, non-covered portion of the body of the hang tag piece 4, open to the inner cavity 8 to allow the label 10 to be displayed. Preferably, a clear protective piece 12 provides protection for the label 10, slides into the hang tag piece inner cavity 8, and is visible through the hang tag piece open display 40, while accommodating a user seeing through it to the description and/or notations 9 written on the label 10. However, alternative embodiments include a top display 40 having an attached, permanent protector made of clear plastic, glass, or any other clear or translucent material configured for protecting the label 10, holding the label 10 in place, and allowing the label 10 to be displayed.

In an exemplary embodiment of the present invention, a case 32 having open and closed configurations includes an internal space configured for receiving and housing an object to be organized and an attached hang tag piece 4 and includes one or more case labels 34 which are externally viewable with the case 32 in its closed configuration. In a preferred embodiment, the case 32 is made of a clear material, such as but not limited to clear plastic or glass, to display a case label 34 positioned inside the case 32. However, alternative embodiments include non-transparent cases 32 of any color(s). Such non-transparent cases 32 may include a clear outer receiver for receiving a case label 34 or may be configured for having a case label 34 attached via adhesive or another mode of attachment. The case 32 may include one or more case labels 34 corresponding to the label 10 on the hang tag piece 4 and may include further description of the object itself or files saved on the object. Such corresponding case labels 34 and hang tag labels 10 accommodate efficient organization, storage, identification, and retrieval of objects.

In a preferred embodiment, the case 32 includes a molded receiver 36 configured for holding the object and hang tag piece 4 without the object and hang tag piece 4 sliding around within the case 32. Embodiments of the case may further include clips, hook and loop fasteners, or other attachment mechanisms for attachment to the object and/or hang tag piece 4. Preferably, the case 32 will include a snapping open and close mechanism. However, alternative opening and closing mechanisms can be utilized in embodiments of the present invention, such as but not limited to magnetic closure(s), hook and loop fastener(s), buckle(s) and strap(s), and clip(s). Multiple cases 32 of the present invention can easily be stored in bookcases, file cabinets, drawers, or any other desired location for easy organization, storage, identification, and retrieval.

Figure 11:
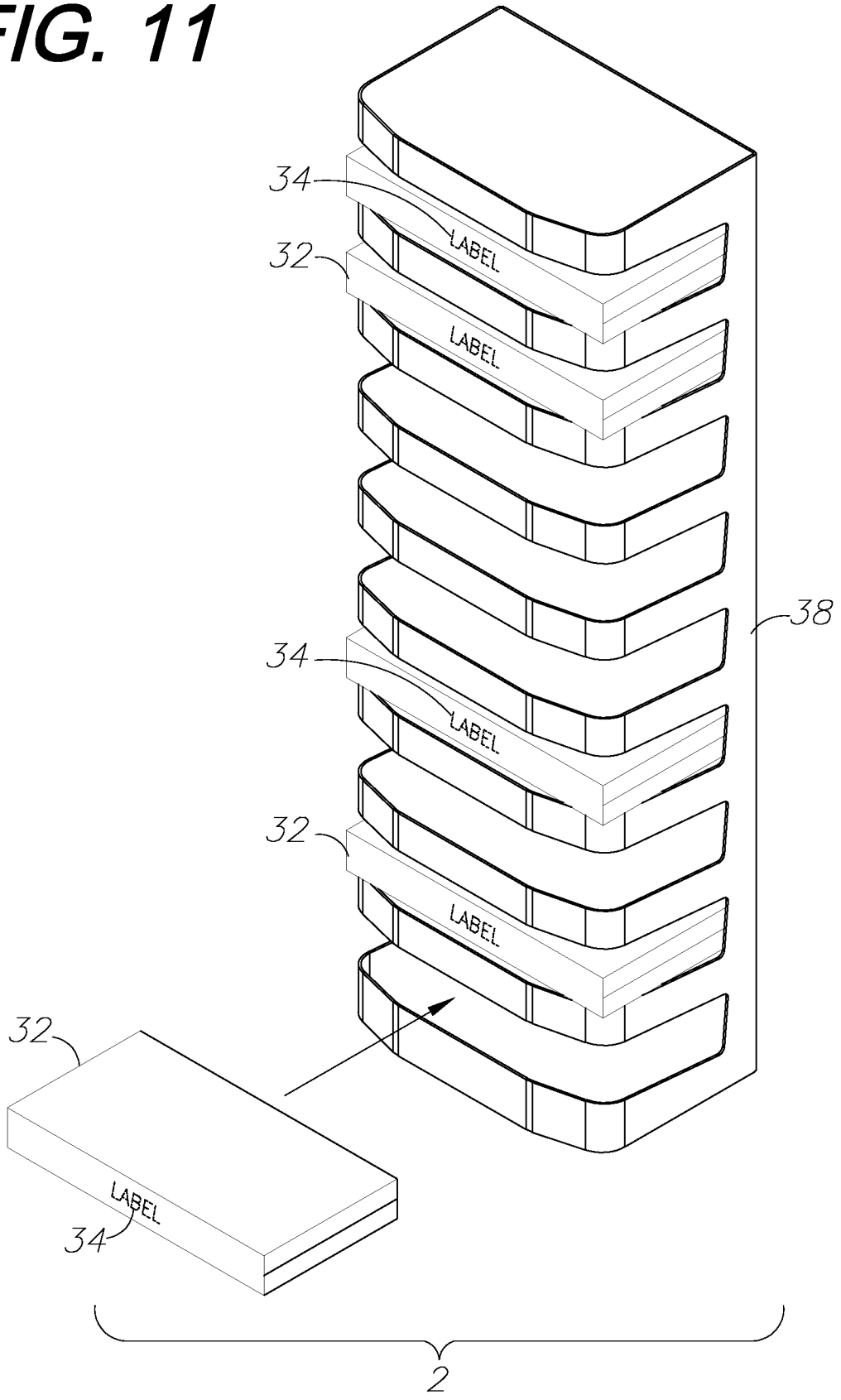
FIG. 11 is an upper, front, partially-exploded, perspective view of a case organizer of the organization and storage system with one case exploded from the case organizer.

In an exemplary embodiment, as shown in FIG. 11, the present organization and storage system 2 further includes an integrated case organizer 38 configured for holding multiple cases 32 of the present invention. Such an organizer 38 may be placed within a drawer, on a desk, on a shelf, or anywhere else a user desires. Use of an integrated case organizer 38 allows for easy organization of objects alphabetically, by date, by category, and/or any other logical order. In some embodiments, the present invention may optionally further integrate sensors and/or tracking mechanisms attached to the hang tag pieces 4 and/or cases 32 for determining which particular case(s) 32 and object(s) have been removed from the case organizer 38 to even further keep track of the content organized and stored with the system 2. The system 2 could further be digitized and utilize an associated smartphone mobile application and/or website platform for keeping track of objects organized and stored in the system 2 and/or for sending optional remote notifications, such as but not limited to emails, text messages, and/or push notifications when a case 32 and/or object has been removed from the system organizer 38 and/or returned.

In use of an exemplary embodiment of the present invention, as illustrated by FIGS. 1-10, a hang tag piece 4 is attached to a flash drive 28 via a small chain, lanyard, or alternative attachment piece 29 connected around the lanyard loop 44 of the flash drive 28 and around a hang tag piece end attachment hole 22, 24, preferably the hole 24 on the opposite side of the hang tag piece end slot opening 6. A description or notation 9 regarding the contents of the flash drive 28 are written on a label 10; the label 10 is inserted into a protective piece 12; and the label 10 and protective piece 12 are inserted into the inner cavity 8 of the hang tag piece 4 through the end slot opening 6, with at least a portion of the written description or notation 9 displayed through the protective piece 12 and hang tag open display 40. Preferably, a key ring or alternative locking piece 26 is attached through the planar first end holes 22 on the same end as and positioned through the end slot opening 6, retaining the label 10 and protective piece 12 within the hang tag inner cavity 8. A corresponding case label 34 is written and placed on or in a case 32 so that the case label 34 is displayed from outside of the case 32 in a closed configuration. The flash drive 28 with the attached, labeled hang tag piece 4 is placed within the corresponding case 32, preferably in a molded receiver 36 for the flash drive 28 and hang tag piece 4, and the case 32 is closed. The case 32 holding the flash drive 28 and hang tag piece 4 can then be stored as desired, accommodating quick and efficient organization, storage, identification, and retrieval of the flash drive 28 and its associated digital content.

In an exemplary embodiment, the present organization and storage system 2 and method of use are utilized with everyday consumer digital files. Additionally, the present invention could be used by the music and entertainment industries for retail sales of music and movies on flash drives. The entertainment and movie industries can print movie and music album covers and information for placement on hang tags 4 and cases 32 of the present invention, similar to previous covers and information used with retail DVDs, Blu-ray Discs, CDs, cassette tapes, vinyl records, etc. The present invention could also be used for retail sales of electronic books (e-books) and audiobooks on flash drives. Further industries and markets that may utilize the organization and storage system 2 include but are not limited to homes, schools, businesses, hospitals, offices, and anyone else wanting to efficiently organize and store various objects.

It is to be understood that the invention can be embodied in various forms and is not to be limited to the examples specifically discussed above. The range of components and configurations which can be utilized in the practice of the present invention is virtually unlimited.

Having thus described the invention, what is claimed as new and desired to be secured by Letters Patent is:

1. An organization and storage system comprising:

a hang tag piece having top, bottom, left, and right sides and first and second ends and configured for attachment to an object to be organized and stored;

said hang tag piece first end comprising an end slot opening connected to an inner cavity within said hang tag piece;

said hang tag piece further comprising a hang tag label corresponding to said object to be organized and stored;

said hang tag piece further comprising a protective piece configured for receiving and protecting said hang tag label and for insertion into said inner cavity through said end slot opening;

said protective piece comprises two layers of a clear protective material connected at a joined end and having open remaining sides;

said inner cavity configured for receiving and housing said protective piece and said hang tag label in an assembled configuration;

said hang tag piece top side comprising a display open to said inner cavity and configured for displaying said hang tag label through said protective piece in said assembled configuration;

said hang tag piece first end further comprising first end attachment holes above and below said end slot opening;

said hang tag piece further comprising a locking piece configured for attachment to said hang tag piece through said first end attachment holes and said end slot opening;

wherein said locking piece prevents said protective piece and said hang tag label from falling out of said inner cavity through said end slot opening in said assembled configuration;

a case configured for receiving and housing said hang tag piece and said object to be organized and stored; and said case comprising a case label corresponding with said hang tag label and said object to be organized and stored.

2. The organization and storage system according to claim 1, wherein:

said object to be organized and stored comprises a flash drive storing digital content.

3. The organization and storage system according to claim 1, wherein:

said protective piece joined end comprises a joined end extension configured for guiding said protective piece through said end slot opening and into said inner cavity.

4. The organization and storage system according to claim 1, wherein:

corners of said protective piece slightly extend outward of said end slot opening in said assembled configuration; and said outward-extending corners accommodate easy removal of said protective piece from said inner cavity with said locking piece detached.

5. The organization and storage system according to claim 1, wherein:

said locking piece comprises a key ring.

6. The organization and storage system according to claim 1, wherein:

said case further comprises a molded receiver configured for receiving and holding said hang tag piece and said object to be organized and stored.

7. The organization and storage system according to claim 1, wherein:

said hang tag piece second end further comprises a second end attachment hole.

8. The organization and storage system according to claim 1, wherein:

said hang tag label comprises a folded sheet of paper having an outward-facing fold and inner folds;

said outward-facing fold comprising an identification notation of said object to be organized and stored; and said inner folds comprising a specific description of the contents of said object to be organized and stored.

9. The organization and storage system according to claim 1, further comprising:

a case organizer configured for receiving, housing, and storing multiple cases.

10. An organization and storage system comprising:

a hang tag piece having top, bottom, left, and right sides and first and second ends and configured for attachment to a flash drive to be organized and stored;

said hang tag piece first end comprising an end slot opening connected to an inner cavity within said hang tag piece;

said hang tag piece further comprising a hang tag label corresponding to said flash drive;

said hang tag piece further comprising a protective piece configured for receiving and protecting said hang tag label and for insertion into said inner cavity through said end slot opening;

wherein said protective piece comprises two layers of a clear protective material connected at a joined end and having open remaining sides;

said inner cavity configured for receiving and housing said protective piece and said hang tag label in an assembled configuration;

said hang tag piece top side comprising a display open to said inner cavity and configured for displaying said hang tag label through said protective piece in said assembled configuration;

said hang tag piece first end further comprising first end attachment holes above and below said end slot opening;

said hang tag piece further comprising a key ring configured for attachment to said hang tag piece through said first end attachment holes and said end slot opening;

wherein said key ring prevents said protective piece and said hang tag label from falling out of said inner cavity through said end slot opening in said assembled configuration;

a case configured for receiving and housing said hang tag piece and said flash drive;

said case further comprising a molded receiver configured for receiving and holding said hang tag piece and said flash drive; and said case comprising a case label corresponding with said hang tag label and said flash drive.

11. An organization and storage method using a hang tag piece having top, bottom, left, and right sides and first and second ends; the hang tag piece first end including an end slot opening connected to an inner cavity within the hang tag piece; the hang tag piece further including a clear protective piece; the hang tag piece top side including a display open to the inner cavity; the hang tag piece first end further including first end attachment holes above and below the end slot opening; the hang tag piece further including a locking piece; and a case, the method comprising the steps of:

providing a flash drive to be organized and stored;

providing a hang tag label corresponding to said flash drive;

placing said hang tag label within said clear protective piece;

said clear protective piece enclosing said hang tag label;

sliding said clear protective piece through said end slot opening and into said inner cavity;

said display displaying said clear protective piece and an outward-facing side of said hang tag label through said clear protective piece;

attaching a key ring to said hang tag piece through said first end attachment holes and through said end slot opening;

attaching said flash drive to said hang tag piece; providing a case label corresponding to said hang tag label and said flash drive;

marking said case with said case label; placing said hang tag piece and said flash drive within said case;

closing said case; and organizing and storing said case, said organizing and storing said case comprises placing said case within a case organizer in an organized fashion relative to other cases in said case organizer.

12. The method according to claim 11, wherein:

said providing a hang tag label corresponding to said flash drive comprises drafting notations on a sheet of paper corresponding to the name or contents of said flash drive.

13. The method according to claim 12, wherein:

said drafting notations on a sheet of paper corresponding to the name or contents of said flash drive comprises folding a sheet of paper forming an outward-facing fold and inner folds, drafting an identification notation of said flash drive on said outward-facing fold; and drafting a specific description of the contents of said flash drive on said inner folds.

14. The method according to claim 11, further comprising the steps of:

removing said key ring from said hang tag piece;

removing said protective piece from said inner cavity through said end slot opening;

opening said protective piece; and removing said hang tag label.

15. The method according to claim 11, wherein:

said hang tag piece second end further includes a second end attachment hole; and said attaching said flash drive to said hang tag piece comprises attaching said flash drive to said hang tag piece via an attachment piece through said second end attachment hold and through a lanyard hole on said flash drive.

16. The method according to claim 11, further comprising the step of:

placing a molded receiver for said hang tag piece and said flash drive in said case; and wherein said placing said hang tag piece and said flash drive within said case comprises placing said hang tag piece and said flash drive within said molded receiver.

17. The method according to claim 11, wherein:

said providing a case label corresponding to said hang tag label and said flash drive comprises drafting notations on a sheet of paper corresponding to said hang tag label and the name or contents of said flash drive.

18. The method according to claim 11, further comprising the step of:

attaching a lanyard to said key ring for transport of said hang tag piece and said flash drive.

* * * * *